US010401121B2

(12) United States Patent
Hague et al.

(10) Patent No.: US 10,401,121 B2
(45) Date of Patent: Sep. 3, 2019

(54) PNEUMATIC PROJECTILE LAUNCHING SYSTEM

(71) Applicant: POLARSTAR ENGINEERING & MACHINE LLC, Newark, DE (US)

(72) Inventors: Stephen J. Hague, Newark, DE (US); Benjamin Noji, Landenberg, PA (US); Justin Hall, Newark, DE (US); Ross Jutras, Newark, DE (US)

(73) Assignee: POLARSTAR ENGINEERING & MACHINE LLC, Newark, DE (US)

( * ) Notice: Subject to any disclaimer, the term of this patent is extended or adjusted under 35 U.S.C. 154(b) by 171 days.

(21) Appl. No.: 15/561,260

(22) PCT Filed: Apr. 4, 2016

(86) PCT No.: PCT/US2016/025863

§ 371 (c)(1),
(2) Date: Sep. 25, 2017

(87) PCT Pub. No.: WO2016/161417

PCT Pub. Date: Oct. 6, 2016

(65) Prior Publication Data

US 2018/0120051 A1 May 3, 2018

Related U.S. Application Data

(60) Provisional application No. 62/142,540, filed on Apr. 3, 2015.

(51) Int. Cl.
*F41B 11/00* (2013.01)
*F41B 11/723* (2013.01)
(Continued)

(52) U.S. Cl.
CPC ..... *F41B 11/723* (2013.01); *F41B 11/71* (2013.01); *F41B 11/721* (2013.01); *F41B 11/73* (2013.01)

(58) Field of Classification Search
CPC ..... F41B 11/62; F41B 11/72; F41B 11/721; F41B 11/722; F41B 11/723
See application file for complete search history.

(56) References Cited

U.S. PATENT DOCUMENTS 4,936,282 A * 6/1990 Dobbins ..... F41B 11/52 124/73
5,257,614 A * 11/1993 Sullivan ..... F41B 11/00 124/73

(Continued)

OTHER PUBLICATIONS

International Search Report and Written Opinion, issued by the ISA/U.S. Receiving Office, in regard to corresponding international patent application Serial No. PCT/US2016/025863; dated Jun. 27, 2016; 8 pages. USA.

(Continued)

*Primary Examiner* — Gabriel J. Klein
(74) *Attorney, Agent, or Firm* — Fox Rothschild LLP

(57) ABSTRACT

A pneumatic assembly for a projectile launching system including a body defining a continuous bore is provided. A nozzle is positioned within the bore adjacent the forward end of the body and is moveable between a rearward position wherein the nozzle facilitates passage of a projectile through a projectile port and a forward position wherein the nozzle blocks the projectile port to prevent passage of a projectile therethrough.

10 Claims, 9 Drawing Sheets

(51) Int. Cl.

| | |
|---|---|
| ***F41B 11/721*** | (2013.01) |
| ***F41B 11/71*** | (2013.01) |
| ***F41B 11/73*** | (2013.01) |

(56) References Cited

U.S. PATENT DOCUMENTS

| | | | | |
|---|---|---|---|---|
| 7,665,396 | B1 | 2/2010 | Tippmann, Jr. | |
| 7,882,830 | B1 * | 2/2011 | Gabrel | F41B 11/62 124/73 |
| 7,931,018 | B1 | 4/2011 | Lai | |
| 2003/0005918 | A1 * | 1/2003 | Jones | F41B 11/57 124/70 |
| 2006/0162714 | A1 | 7/2006 | Lai | |
| 2006/0207586 | A1 | 9/2006 | Jones | |
| 2007/0012214 | A1 * | 1/2007 | Yeh | F41B 11/62 102/502 |
| 2008/0011283 | A1 * | 1/2008 | Lai | F41B 11/721 124/73 |
| 2009/0178660 | A1 * | 7/2009 | Huang | F41B 11/721 124/73 |
| 2010/0282231 | A1 * | 11/2010 | Chen | F41B 11/72 124/73 |
| 2011/0232618 | A1 | 9/2011 | Gabrel | |
| 2012/0192847 | A1 | 8/2012 | Hague et al. | |
| 2014/0331984 | A1 | 11/2014 | Brahler, II et al. | |
| 2015/0059726 | A1 | 3/2015 | Harvey et al. | |

OTHER PUBLICATIONS

Extended European Search Report, issued by the European Patent Office, regarding corresponding patent application Serial No. EP 16774397.0; dated Oct. 4, 2018; 12 pages.

* cited by examiner

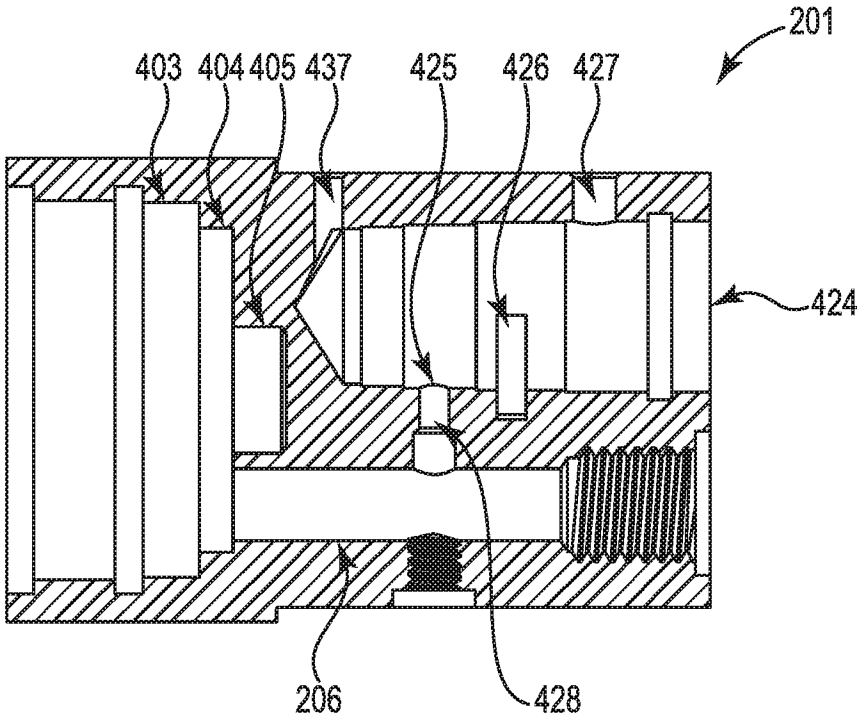
Fig. 6
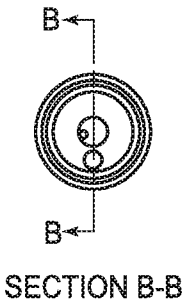

PNEUMATIC PROJECTILE LAUNCHING SYSTEM

CROSS REFERENCE TO RELATED APPLICATIONS

This application is a national stage patent application of International patent application Serial No. PCT/US2016/025863, filed on Apr. 4, 2016; which claims the benefit of U.S. Provisional patent application No. 62/142,540, filed on Apr. 3, 2015; the entireties of which are hereby incorporated by reference.

FIELD OF THE INVENTION

The present invention relates to a pneumatically operated projectile launching system particularly for use in airsoft guns.

BACKGROUND OF THE INVENTION

Current airsoft projectile launching systems (as well as non-airsoft systems) include pneumatic and spring power sources. Existing designs suffer from deficiencies that affect accuracy, usability and/or durability.

For example, current spring-powered launching systems use a compressed spring to drive a piston longitudinally within a cylinder, compressing air in front of the piston. As the air is compressed it is directed behind the projectile to launch the projectile from a barrel. The spring may be compressed by human power or by an electric motor. Due to the stresses applied by the compressed spring, these types of systems are prone to mechanical failure. Pneumatic launching systems exist but still suffer from shortcomings in performance and usability as well as limitations in compatibility with equipment that is common in the sport of airsoft.

There is therefore a need for improved projectile launching systems.

SUMMARY OF THE INVENTION

In at least one aspect of the invention a pneumatically operated projectile launching system including a pneumatic assembly and a means of actuating the fluid control valve contained within the pneumatic assembly is provided. The fluid control valve is preferably a solenoid valve, actuated electrically by signals received from an electronic control unit, however, electronic control is not necessary for operation of the system and the fluid control valve may also be actuated mechanically or pneumatically.

In operation, a constant supply of compressed gas is supplied to the input port of the pneumatic assembly. When the system is idle, this compressed gas fills a firing chamber surrounding the nozzle section and biases the nozzle in the rearward position. The fluid control valve is a "3-way" normally closed (NC) poppet or spool valve which prevents the flow of gas from the input port of the valve until it is actuated. When the valve is actuated the input port is in fluid communication with the first output port, allowing gas to flow between them. When the valve is idle the first output port is in fluid communication with the second output port, which in turn is in fluid communication with the atmosphere. The input port of the solenoid is in constant fluid communication with the input port of the pneumatic assembly through a flow control port in the rear cylinder. The size of the flow control port allows the velocity of the nozzle to be limited without reducing the force applied to the nozzle.

While the nozzle is in the rearward position, gas flow through the nozzle is prevented by a seal between the nozzle and the secondary valve body. The nozzle is configured for fluid actuation to a forward position by gas flow through the fluid control valve acting upon the rear face of the nozzle. When the system is firing, a fluid control valve directs compressed gas from the firing chamber to the rear surface of the nozzle. As the rear surface area of the nozzle is greater than the front surface area, the nozzle is actuated to the forward position to chamber a projectile. When the nozzle reaches the full forward position it travels beyond the sealing surface of the secondary valve body, allowing compressed gas to flow through a series of radial ports in the nozzle, then through the bore of the nozzle and launch the projectile. Compressed gas will continue to flow through the nozzle until the fluid control valve is deactivated, allowing the nozzle to return to the rearward position.

Various aspects of the invention are designed for use in conventional airsoft guns bodies. Breech, barrel and magazine are provided by the gun body in which one aspect of the invention is installed. The trigger may be part of the launching system or part of the gun body. Some aspects make use of the existing AEG (Automatic Electric Gun) gearbox housing as a host to adapt the launching system to existing airsoft gun bodies; other aspects can be manufactured as standalone systems which may be installed in place of the original AEG gearbox. Additionally, other aspects can be manufactured as an integral component of an airsoft gun.

In other aspects of the invention a pneumatic assembly for a projectile launching system includes a body defining a continuous bore from a substantially open forward end of the body to a substantially closed rearward end of the body; a nozzle positioned within the bore adjacent the forward end of the body, the nozzle moveable between a rearward position wherein the nozzle facilitates passage of a projectile through a projectile port and a forward position wherein a projectile is fired and nozzle blocks the projectile port to prevent passage of an additional projectile therethrough; and a fluid control valve, actuatable between a first position that facilitates passage of fluid from an input port to a rear of the nozzle and a second position that prevents passage of fluid from an input port to the rear of the nozzle while also allowing passage of fluid from the rear of the nozzle to atmosphere.

In other aspects the pneumatic assembly further includes a nozzle stem, upon which the nozzle seals and through which fluid can flow between the nozzle fluid chamber and the fluid control valve.

In other aspects of the invention, the nozzle includes a forward radial seal and a rear radial seal, the radial seals extending from a sail at the rear of the nozzle and separated by one or more radial ports, the forward radial seal biasing the nozzle in the rearward position while also preventing the flow of fluid from a firing chamber through the one or more radial ports until the nozzle has traveled a specific distance in the forward direction, the rear radial seal and seal on the nozzle stem creating a nozzle fluid chamber to receive fluid from a fluid control valve.

In other aspects the pneumatic assembly further comprises a secondary valve body including a bore into which the nozzle stem extends and within which the nozzle linearly moves, said bore for providing an internal passage for fluid between the firing chamber and an input port.

In other aspects the pneumatic assembly further comprises a means for actuating the fluid control valve. In other aspect the means for actuating the fluid control valve comprises a solenoid valve actuatable by signals received from an electronic control unit.

In other aspects the fluid control valve of the pneumatic assembly is a poppet or spool valve in a normally closed position.

In other aspects the rear surface area of the nozzle of the pneumatic assembly is greater than a front surface area of the nozzle.

BRIEF DESCRIPTION OF THE DRAWINGS

For a better understanding of the invention, and to show how the same may be carried into effect, reference will now be made, by way of example, to the accompanying drawings, in which:

FIG. 6 is a cross-sectional view of the rear cylinder.

DETAILED DESCRIPTION OF THE INVENTION

Figure 1:
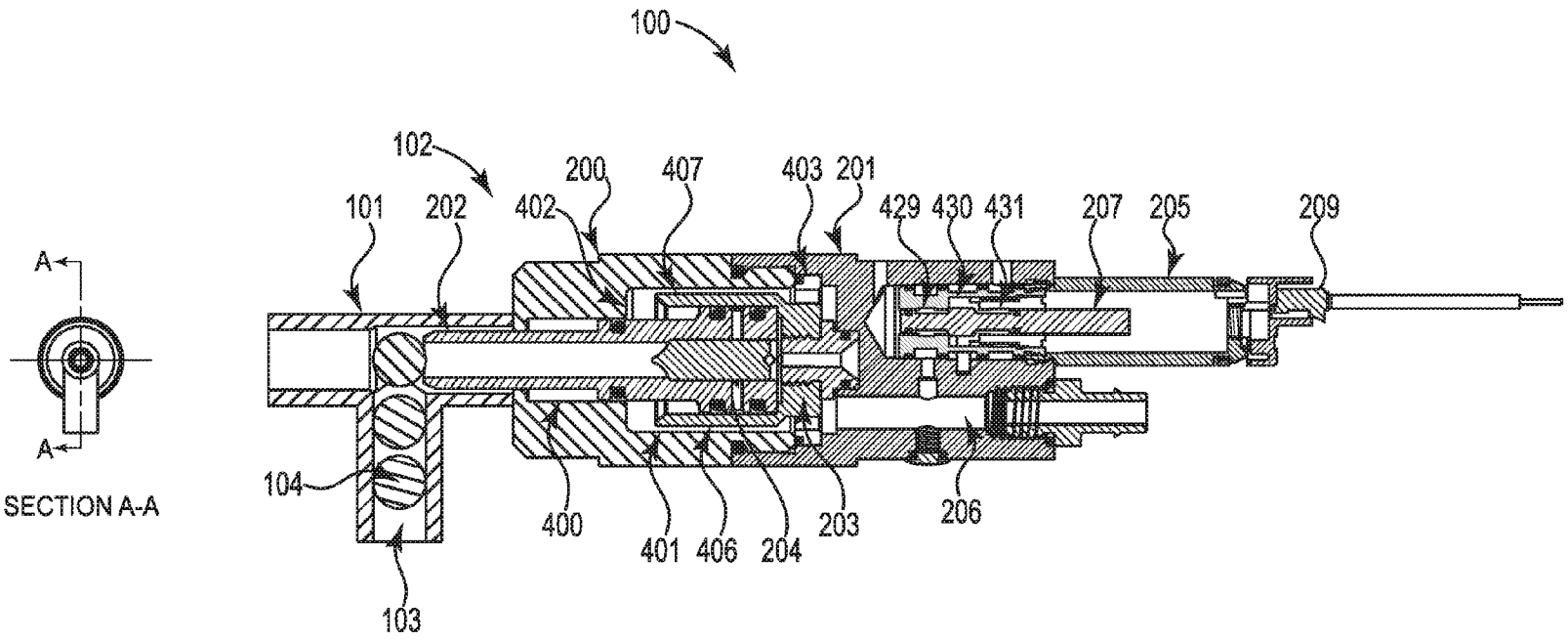
FIG. 1 is a cross-sectional view of an exemplary pneumatic assembly in an idle/ready to fire position.

In the drawings, like numerals indicate like elements throughout. Although the invention is illustrated and described herein with reference to specific aspects, the invention is not intended to be limited to the details shown. Rather, various modifications may be made in the details within the scope and range of equivalents of the claims and without departing from the invention. The invention is described below with reference to a compressed gas, however, it is understood that the compressed gas may be any fluid as known to those skilled in the art or which may become discovered by those skilled in the art.

Referring to the figures, the pneumatic assembly 100 may be utilized with a breech 101, a hop-up chamber or the like as known in the art. The breech 101 may be positioned adjacent an open end 102 of the pneumatic assembly 100 such that a bore therethrough is coaxial with a nozzle 202 of the pneumatic assembly 100. The breech 101 includes a projectile port 103 which supplies projectiles 104, for example, from a hopper, magazine or the like as is known in the art.

Figure 2:
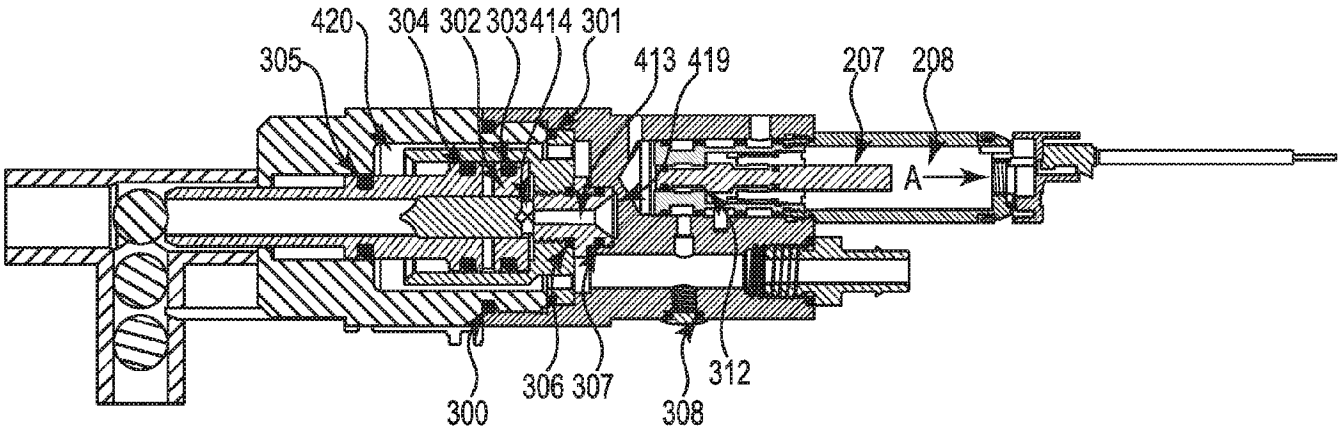
FIG. 2 is a cross-sectional view of the pneumatic assembly of FIG. 1 in a firing, fluid control valve actuated, nozzle rearward position.
Figure 2:
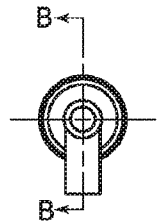

Referring to FIGS. 1 and 2, the exemplary pneumatic assembly 100 includes a front cylinder 200 and a rear cylinder 201 joined longitudinally to house the components of the assembly. An o-ring 300 forms a seal at the joint between the front cylinder 200 and the rear cylinder 201. The front cylinder 200 defines a series of bores 400, 401 of varying sizes. The bores 400, 401 are concentric in the figures, however, they may also be eccentric. The shoulder 402 formed by the forward bores 400, 401 of the front cylinder 200 acts as a stop to limit the forward travel of the nozzle 202. Referring to FIG. 6, the rear cylinder 201 defines a series of concentric bores 403, 404, 405 of varying sizes. A middle bore 404 in the rear cylinder 201 intersects with the bore of the input port 206 allowing compressed gas to flow into the rear cylinder 201.

Figure 5:
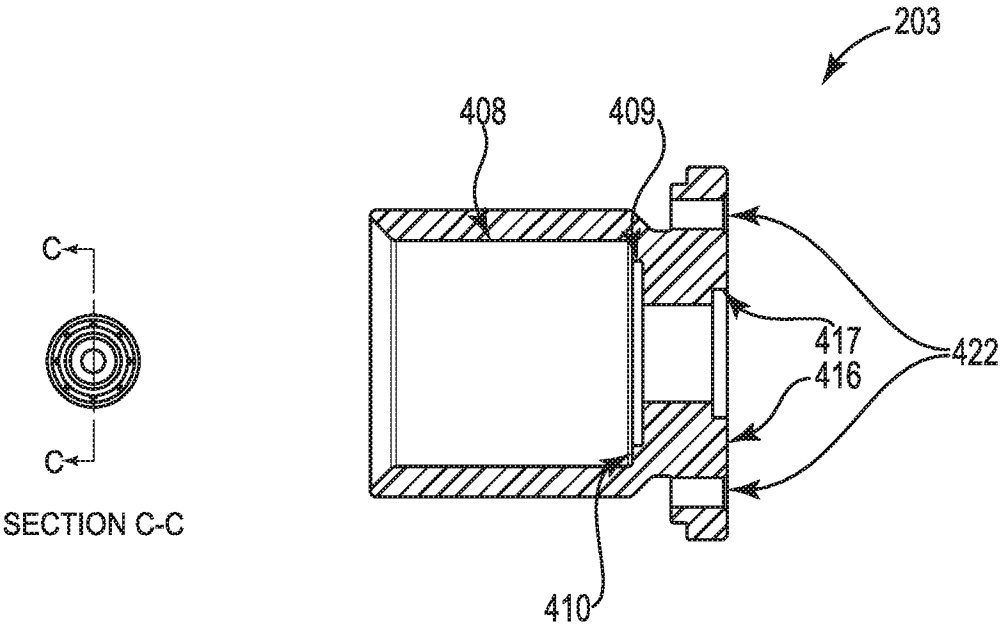
FIG. 5 is a cross-sectional view of the secondary valve body.
Figure 7:
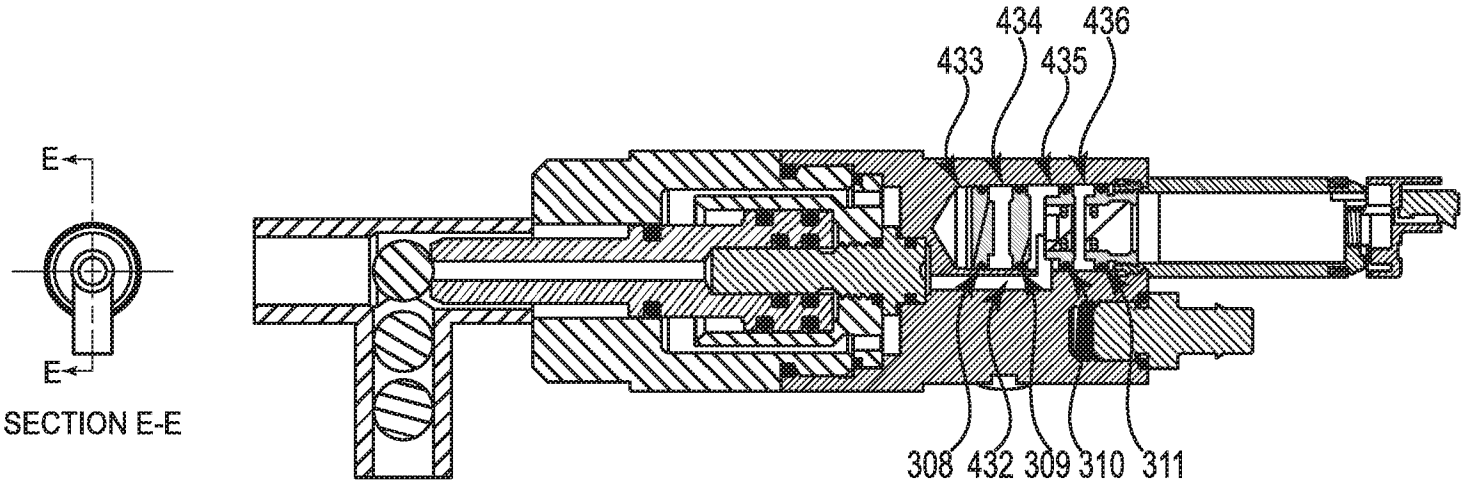
FIG. 7 is a sectional view of the pneumatic assembly of FIG. 1 in an idle ready to fire position where the section plane intersects the centerline of the gas passage in the rear cylinder.
Figure 8:
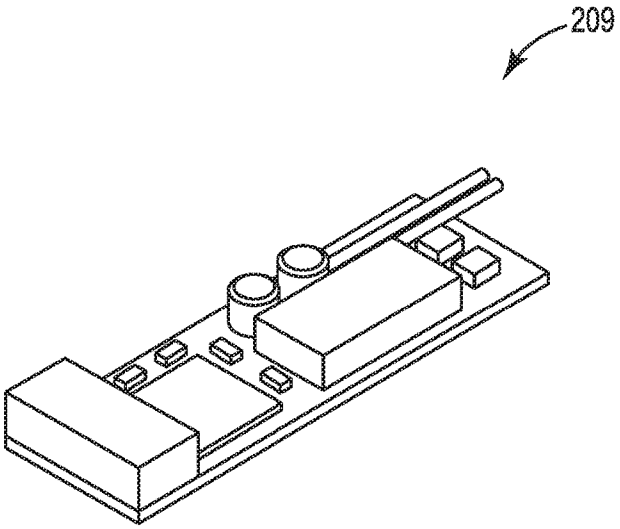
FIG. 8 is a perspective view of an example electronic control unit.

Referring to FIGS. 1, 2 and 5, a tubular secondary valve body 203 may be retained in the bore 403 of the rear cylinder 201. The secondary valve body 203 defines a series of concentric bores 408, 409. The shoulder 410 formed by the bores 408, 409 acts as a stop to limit the rearward travel of the nozzle 202. An o-ring 301 in the bore 403 acts as a crush washer and seal between the secondary valve body 203 and the front cylinder 200. A forward tubular protrusion 406 of the valve body 203 extends into the rearmost bore 401 of the front cylinder 200. The outside diameter of the forward protrusion 406 may be less than the inside diameter of the bore 401 of the front cylinder 200 and the length of the protrusion 406 may be less than the depth of the bore 401 of the front cylinder 200 such that a compressed gas passage 407 is formed between the secondary valve body 203 and the front cylinder 200. A series of ports 422 located radially around the secondary valve body 203 place the bores 403, 404, 405 of the rear cylinder 201 in constant fluid communication with the gas passage 407 between the secondary valve body 203 and the front cylinder 200.

Figure 3:
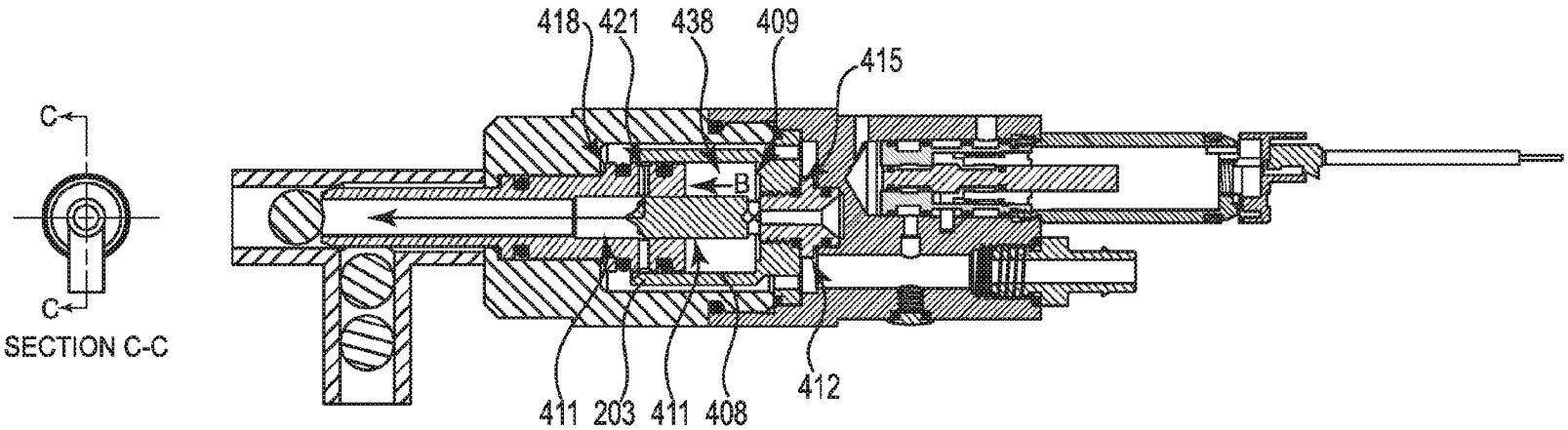
FIG. 3 is a cross-sectional view of the pneumatic assembly of FIG. 1 in a firing, fluid control valve actuated, nozzle forward position.

Referring to FIGS. 1-3, a cylindrical nozzle stem 204 extends into the bores 408, 409 of the valve body 203 and may be retained against the rear face 416 of the secondary valve body 203. The nozzle stem 204 may be defined by two or more diameters 411, 412, the forward diameter being smaller than the rear diameter. The shoulder 415 formed by the two diameters 411, 412 acts as a stop to locate the nozzle stem 204 within the secondary valve body 203. A bore 413 in the nozzle stem 204 places the rear face 419 of the nozzle stem 204 in fluid communication with one or more radial ports 414 in the forward diameter 411 of the nozzle stem 204. The ports 414 are located longitudinally along the nozzle stem 204 such that when the nozzle stem 204 may be retained against the rear face 416 of the secondary valve body 203, the ports 414 are within the internal bores 408, 409 of the valve body. An o-ring 306 may be located at the base of the forward diameter 411 of the nozzle stem 204 and seals on the inside of a bore 417 in the rear face 416 of the secondary valve body 203. An external groove in the rear diameter 412 of the nozzle stem 204 receives an o-ring 307 and seals on the inside of a rear bore 405 of the rear cylinder 201. In other aspects of the invention, the nozzle stem 204 may be removed entirely. In this aspect the back of nozzle 202 would be closed off. This would result in slightly more compressed air being used.

Referring to FIGS. 1-6, the tubular nozzle 202 slides in the bores 400, 408 of the front cylinder 200 and the secondary valve body 203. The tubular nozzle 202 also slides on the nozzle stem 204. An internal groove in the nozzle 202 receives an o-ring 302 and seals on the outside of the forward diameter 411 of the nozzle stem 204. A rear sail 418 extends radially from the rear of the nozzle 202 and two external grooves in the nozzle rear sail 418 receive o-rings 303, 304 and seal on the inside of the forward bore 408 of the secondary valve body 203. A series of radial ports 421 are located between the external o-rings 303, 304 in the nozzle rear sail 418 and extend into the nozzle bore 423. The rear external o-ring 303 in the rear sail 418 may be located so that it remains sealed within the forward bore 408 of the secondary valve body 203 at all times. The forward o-ring 304 in the nozzle rear sail 418 may be located so that it has left the forward bore 408 of the secondary valve body 203 and is no longer sealing when the nozzle 202 has reached the full forward position. Forward of the rear sail 418, a second external groove receives an o-ring 305 and seals on the inside of the forward bore 400 of the front cylinder 200. This forms a firing chamber 420 that can receive and release a volume of compressed gas through the gas passage 407 formed by the secondary valve body 203 and the front cylinder 200. The firing chamber 420 also releases compressed gas through the radial ports 421 in the nozzle 202 when the nozzle 202 is in the full forward position. The seals formed by the rear o-ring 303 in the nozzle rear sail 418 and the internal o-ring 302 of the nozzle 202 form a nozzle fluid chamber 438 that can receive and release a volume of compressed gas from the valve output port fluid control valve 205 through the nozzle stem 204 from a gas passage 432 in the rear cylinder 201. Those of skill in the art will appreciate that rather than routing air internally from the source of supply to the nozzle sail 418, an external airline may be used that routes compressed gas to the front of the nozzle sail.

Referring to FIGS. 1-3, 6 and 7, the fluid control valve 205 may be secured into a bore 424 of the rear cylinder 201. The fluid control valve 205 may be a "3-way" valve. In this particular aspect of the invention, the fluid control valve 205 may be a MAC 3-Way Bullet Valve solenoid valve. A solenoid coil 208 integral to the Bullet Valve provides the actuating force on the fluid control valve stem 207 when power is applied by the electronic control unit 209.

Four external grooves in the fluid control valve 205 receive o-rings 308, 309, 310, 311 which seal on the inside of the bore 424 of the rear cylinder 201 and divide the bore 424 longitudinally into four isolated sections 433, 434, 435, 436. The forward section 433 may be in fluid communication with atmosphere through a vent port 437 in the rear cylinder 201, allowing gas in front of the fluid control valve 205 to be drawn in from and vented to atmosphere as the fluid control valve stem 207 moves. The second section 434 places the valve input port 429 in constant fluid communication with the input port 206 through a flow control port 428. The third section 435 places the nozzle fluid chamber 438 in constant fluid communication with the valve output port 430 through the nozzle stem 204 and gas passage 432 in the rear cylinder 201. The fourth section 436 places the valve exhaust port 431 in constant fluid communication with atmosphere.

The fluid control valve 205 may be configured to prevent the flow of gas from the valve input port 429, but allow flow between the valve output port 430 and the valve exhaust port 431, until the fluid control valve 205 is actuated. When the fluid control valve 205 is actuated, compressed gas is allowed to flow between valve input port 429 and the valve output port 430, which is in constant fluid communication with the nozzle fluid chamber 438. While the fluid control valve 205 is actuated, the valve exhaust port 431 remains in fluid communication with atmosphere, but isolated from the compressed gas within the pneumatic assembly 100.

The fluid control valve 205 and compressed gas passages to and from the fluid control valve 205 are located within the rear cylinder 202, however, the fluid control valve may be located separate from the pneumatic assembly 100 as well.

Figure 4:
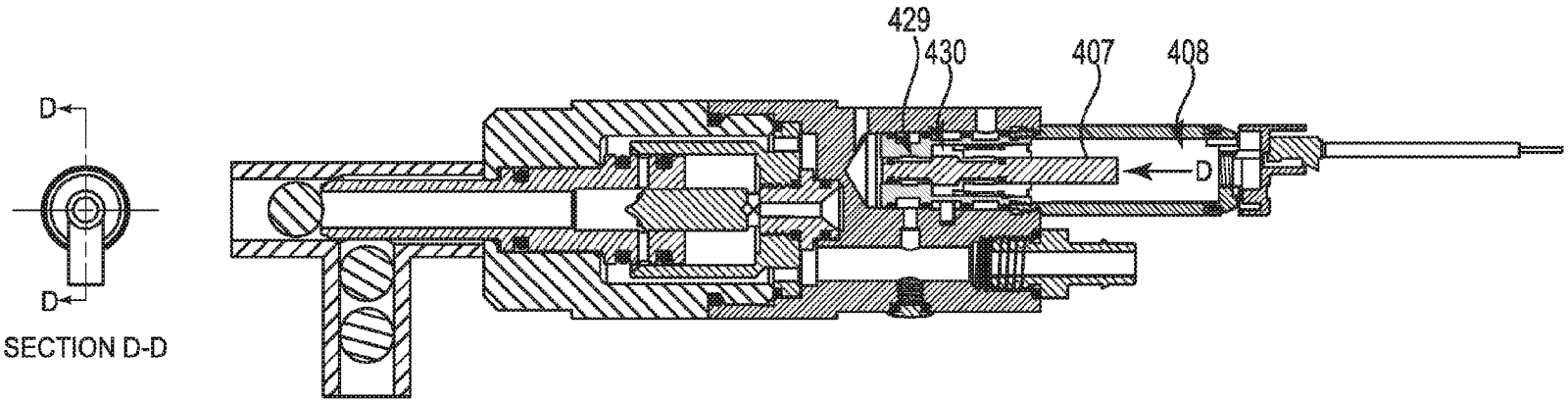
FIG. 4 is a cross-sectional view of the pneumatic assembly of FIG. 1 after firing in a closing, fluid control valve deactivated, nozzle forward position.

A firing sequence will be explained with reference to FIGS. 1-4. In FIG. 1, the fluid control valve 205 is in a default, closed position such that flow between the valve input port 429 and the valve output port 430 is prevented. Referring to FIG. 2, upon actuation of the solenoid coil 208, for example via a trigger (not shown), the valve stem 207 may be moved reward as indicated by arrow A and gas is allowed to flow between the valve input port 429 and the valve output port 430 then into the nozzle fluid chamber 438. The gas contacts the rear of the nozzle 202 and pushes the nozzle forward as indicated by arrow B in FIG. 3. As the nozzle 202 moves sufficiently forward, the forward o-ring 304 in the nozzle rear sail 418 leaves the forward bore 408 of the secondary valve body 203 and gas flows through the radial ports 421 and out of the nozzle 202, as indicated by arrow C, to fire the projectile 104. Referring to FIG. 4, the solenoid coil 208 may be deactivated such that the fluid control valve 205 returns to its default closed position, as indicated by arrow D. Gas flow between the valve input port 429 and valve output port 430 is stopped and compressed gas in the nozzle fluid chamber 438 is allowed to vent to atmosphere through the fluid control valve 205. As gas pressure has been removed from the rear of the nozzle 202, gas flow through the ports 422 will return the nozzle 202 to the original position shown in FIG. 1. The process may thereafter be repeated.

Figure 9:
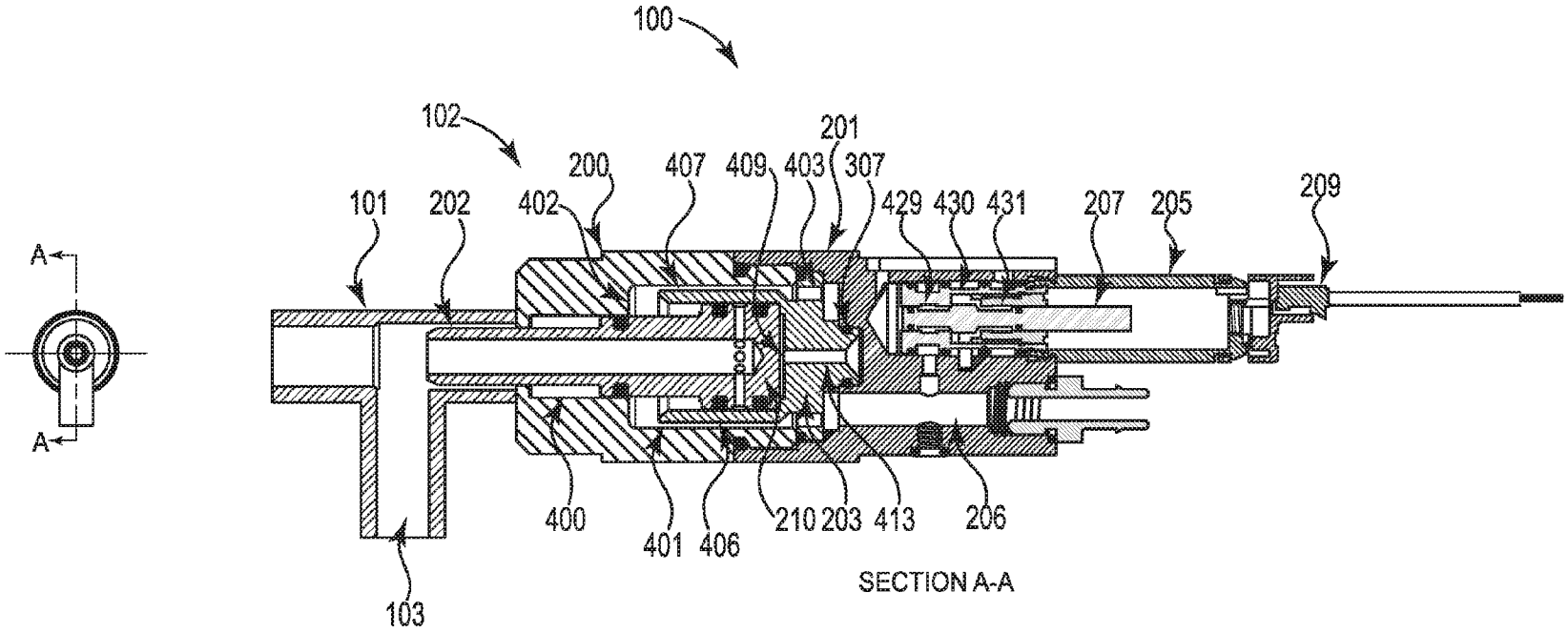
FIG. 9 is a cross-sectional view of an alternative embodiment of an exemplary pneumatic assembly.

Referring now to FIG. 9 another aspect of a pneumatic assembly in accordance with the invention is depicted. Like numerals indicate like elements as in the pneumatic assembly of FIGS. 1-7. Bore 413 in the nozzle stem 204 does not seal on the nozzle stem 204. Rather, the rear face 409 of the nozzle stem 204 has been plugged 210. As a result fluid communication is directed to the entire rear face 409 of the nozzle.

These and other advantages of the present invention will be apparent to those skilled in the art from the foregoing specification. Accordingly, it will be recognized by those skilled in the art that changes or modifications may be made to the above-described aspects without departing from the broad inventive concepts of the invention. It should therefore be understood that this invention is not limited to the particular aspects described herein, but is intended to include all changes and modifications that are within the scope and spirit of the invention as defined in the claims.

What is claimed is:

1. A pneumatic assembly for a projectile launching system comprising: a body defining a continuous bore from a substantially open forward end of the body to a substantially closed rearward end of the body; a nozzle positioned within the bore adjacent the forward end of the body and including a nozzle fluid chamber, the nozzle moveable between a rearward position wherein the nozzle facilitates passage of a projectile through a projectile port and a forward position wherein a projectile is fired and nozzle blocks the projectile port to prevent passage of an additional projectile therethrough; a fluid control valve, actuatable between a first position that facilitates passage of fluid from an input port to a rear of the nozzle and a second position that prevents passage of fluid from an input port to the rear of the nozzle while also allowing passage of fluid from the rear of the nozzle to atmosphere; and a nozzle stem, upon which the nozzle seals and through which fluid can flow between the nozzle fluid chamber and the fluid control valve.

2. The pneumatic assembly of claim 1 wherein the nozzle includes a forward radial seal and a rear radial seal, said radial seals extending from a sail at the rear of the nozzle and separated by one or more radial ports, the forward radial seal biasing the nozzle in the rearward position while also preventing the flow of fluid from a firing chamber through the one or more radial ports until the nozzle has traveled a specific distance in the forward direction, the rear radial seal and a seal on the nozzle stem creating the nozzle fluid chamber that receives fluid from the fluid control valve.

3. The pneumatic assembly of claim 1 further comprising a secondary valve body having a valve body bore into which the nozzle stem extends and within which the nozzle linearly moves, said valve body bore for providing an internal passage for fluid between the firing chamber and an input port.

4. The pneumatic assembly of claim 1 further comprising a means for actuating the fluid control valve.

5. The pneumatic assembly of claim 4 wherein said means for actuating the fluid control valve comprises a solenoid valve actuatable by signals received from an electronic control unit.

6. The pneumatic assembly of claim 1 wherein said fluid control valve is a poppet or spool valve in a normally closed position.

7. The pneumatic assembly of claim 1 wherein a rear surface area of the nozzle is greater than a front surface area of the nozzle.

8. The pneumatic assembly of claim 2 wherein said the secondary valve body defines a series of concentric bores.

9. The pneumatic assembly of claim 8 wherein two of said series of concentric bores form a shoulder that is configured to act as a stop that limits rearward movement of the nozzle.

10. The pneumatic assembly of claim 1 wherein a rear end of the nozzle is plugged.

* * * * *